United States Patent [19]

Hall

[11] 4,268,364

[45] May 19, 1981

[54] NICKEL-ZINC ALLOY DEPOSITION FROM A SULFAMATE BATH

[75] Inventor: Dale E. Hall, Monroe, N.Y.

[73] Assignee: Inco Research & Development Center Inc., Suffern, N.Y.

[21] Appl. No.: 131,448

[22] Filed: Mar. 18, 1980

[51] Int. Cl.[3] ..... C25D 3/56

[52] U.S. Cl. ..... 204/43 Z

[58] Field of Search ..... 204/43 Z, 43 T, 123

[56] References Cited

U.S. PATENT DOCUMENTS 3,691,027 9/1972 Hartford et al. ..... 204/29

FOREIGN PATENT DOCUMENTS 2800258 7/1978 Fed. Rep. of Germany .... 204/43 Z

OTHER PUBLICATIONS

S. Venkatachalam, Bull., India Sect., Electrochem Soc., 10, 93, (1961).

Chemical Abstract, vol. 69, 56463v, (1968).

Chemical Abstract, vol. 78, 66117k, (1973).

J. W. Dini et al., Metal Finishing, pp. 31–33, Aug. 1979.

T. L. Rama Char. Proc. Australian Conf. Electrochem., 1st., pp. 384–391, (1963).

S. Sathyanarayana et al., Bull. India Sect. Electro--Chem. Soc., 5(4), pp. 83–85, (1956).

A. Brenner, "Electrodeposition of Alloys", vol. II, p. 216, (1963).

J. Dini et al., presented at the Gov.-Industry Work--Shop on Alternatives for Cadmium Plating in Met. Fin., (1977).

*Primary Examiner*—G. L. Kaplan

*Attorney, Agent, or Firm*—R. J. Kenny; F. J. Mulligan

[57] ABSTRACT

An electroplating bath and process for producing a nickel-zinc alloy electrodeposit containing about 8% to 35% nickel characterized in that the bath is essentially a boric acid-containing sulfamate bath maintained at a pH of 2.5 to 4.0 and operated at a cathode current density of about 10 to 25 mA $cm^{-2}$ and at a temperature of about 20° C. to 70° C.

8 Claims, 1 Drawing Figure

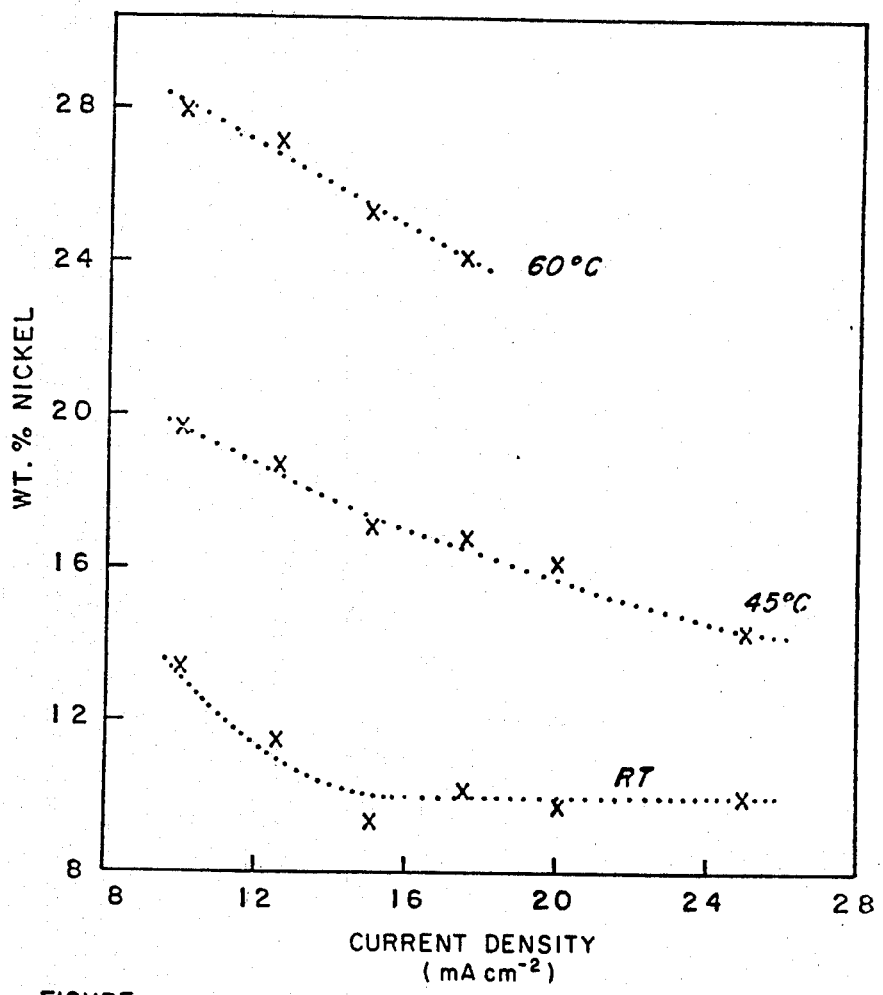
FIGURE

NICKEL-ZINC ALLOY DEPOSITION FROM A SULFAMATE BATH

The present invention is concerned with the electroplating of nickel-zinc alloys.

BACKGROUND AND PROBLEM

In the field of metal finishing there is a need for decorative or quasi-decorative metallic finishes which are sacrificially anodic with respect to a metal being protected. The classic, sacrificially anodic, coating metal is zinc used extensively in galvanized coatings. It is desirable to provide a sacrificially anodic coating metal which has enhanced corrosion resistance compared to zinc.

Electrodeposited nickel-zinc alloy coatings have been suggested for corrosion protection purposes, for example, in the documents abstracted in Chemical Abstracts listed as follows:

69 CA 56463v

78 CA 66117k

The use of an electrodeposited nickel-zinc alloy layer as a part of a plated system involving a corrodible basis metal having successive deposits of zinc-nickel alloy, nickel and chromium is disclosed in U.S. Pat. No. 3,691,027. Other disclosures known to us relative to nickel-zinc plating are as follows:

T. L. Rama Char, Proc. Australian Conf. Electrochem, 1st, Sydney, Hobart, Australia 1963, 384–91.

S. Sathyanarayana and T. L. Rama Char, Bull. India Sect. Electrochem. Soc. 5 (4), 83–85 (1956).

A. Brenner, *Electrodeposition of Alloys* Academic Press, New York, 1963, v. 2, p 216.

J. Dini and H. Johnson, presented at the Government-Industry Workshop on Alternatives for Cadmium Electroplating in Metal Finishing, Oct. 4–6, 1977.

S. Venkatachalam, *Some Peculiar Observations in the Electrodeposition of Nickel-Zinc Alloys from the Sulphamate Bath,* Bull. Indian Section, Electrochem. Soc. 10, 93 (1961).

The present invention is directed to novel plating baths and plating procedures for producing decorative quality or quasi-decorative quality nickel-zinc alloy deposits useful for purposes envisioned by the prior art and for other uses.

OBJECT OF THE INVENTION AND DRAWINGS

It is an object of the invention to provide a novel process and bath for electrodeposition of nickel-zinc alloy deposits.

Other objects and advantages will become apparent from this description taken in conjunction with the drawing in which The FIGURE is a graph showing percent nickel in a nickel-zinc electrodeposit versus current density for a plating bath of the present invention.

GENERAL DESCRIPTION OF THE INVENTION

The present invention contemplates a nickel-zinc electroplating bath which contains about 50 to 60 grams per liter (gpl) of divalent nickel introduced as the sulfamate, about 5 to about 14 gpl of zinc introduced as the sulfate, about 20 to 35 gpl of boric acid with the balance of the bath being essentially water. The bath also contains substances in small amounts such as wetting agents which are commonly used in the electroplating art together with free sulfuric or sulfamic acid sufficient to adjust the pH to a range of 2.5 to 4.0. In operation, the bath is maintained at a temperature of about 20° C. to about 70° C. and electrochemically operated to provide a cathode current density of about 10 to 25 milliamperes per $cm^2$ ($mA\ cm^{-2}$) using either nickel anodes or zinc anodes or a combination of nickel and zinc anodes (with appropriate current distribution) or inert anodes. If anodes of a single metal are used, it is advantageous to employ nickel anodes because it has been found experimentally that less frequent pH adjustments need be made using nickel anodes as opposed to zinc anodes. When operated in accordance with the teachings of the present disclosure, the plating bath of the present invention provides electrodeposits on steel or other substrates which deposits contain, in percent by weight, about 8 to about 35% nickel, balance essentially zinc. In comparison to electrodeposits made from sulfamate baths of other workers, the deposits produced by use of the process of the present invention are essentially free from oxidic inclusions and are produced at high cathode current efficiency.

The compositions of two baths of the present invention are set forth in Table I together with some operating parameters.

TABLE I

| | Bath A | Bath B |
|---|---|---|
| Ni sulfamate | ~231 g/l | ~231 g/l |
| $Ni^{+2}$ | ~54 g/l | ~54 g/l |
| $ZnSO_4 . 7H_2O$ | ~25 g/l | ~55 g/l |
| $Zn^{+2}$ | ~5.7 g/l | ~13 g/l |
| $H_3BO_3$ | ~30 g/l | ~30 g/l |
| pH | 2.5–2.8 | 3.8 |
| T, °C. | 45 | 20–65 |
| i opt, $mA\ cm^{-2}$ | 10–15 | 10–20 |
| % Ni, deposit | 18–24 | 9–30 |
| Cathode current eff., % | 65–100 | >90 |
| Surface tension, dyne $cm^{-1}$ by use of Duponol*, surface tension depressant | ~35 | ~35 |

*Trademark E.I. duPont de Nemours Co. Inc.

Deposits from Bath A as set forth in Table I were semi-bright. Deposits from Bath B, held at 45° C., were relatively dull and gray. These deposits from Bath B containing only about 10% to 15% nickel are highly advantageous in that as described in Example I such deposits are significantly more corrosion resistant than pure zinc.

EXAMPLE I

Specimens of nickel-zinc alloy were electrodeposited on a steel substrate using electroplating Bath B as described in Table I while maintaining the plating bath at 45° C. These specimens and a pure zinc control were subjected to a plurality of cycles of a Copper Accelerated Salt Spray Test (CASS Test). Each CASS Test cycle comprised a four-hour exposure to salt spray at 120° F., the salt spray solution being an aqueous 5% (by weight) solution of sodium chloride acidified to a pH of 3.2 with acetic acid and containing 0.264 gram of $CuCl_2.2H_2O$ per liter of solution (ASTM Specification B-368-62-T). Details of these specimens and CASS test results are set forth in Table II.

TABLE II

| Sample | Cathode Current Density (mA cm$^{-2}$) | Plating Thickness (um) | %Ni | CASS cycle (Rating) 2 | 4 | 6 | 10 |
|---|---|---|---|---|---|---|---|
| 1 | 10 | 13 | ~13 | 10/0[a] | 10/0[a] | 9.0[c] | — |
| 2 | 12.5 | 12 | ~11 | " | " | " | 4/0[e] |
| 3 | 15 | 18 | ~10 | " | " | " | " |
| 4 | 17.5 | 22 | ~12 | " | " | 10/0[a] | 6/0[b] |
| Bright Zinc | — | 13 | 0 | " | 5/0[b] | 2/0[d] | |

[a]= Excessive staining
[b]= Intermediate amount of pinhole rust, intermediate amount of rust staining, excessive staining
[c]= Small pinhole rust, excessive staining
[d]= Excessive pin hole rust, excessive rust staining
[e]= Excessive pin hole rust, intermediate rust staining, excessive stain

EXAMPLE II

Samples of nickel-zinc alloy were electrodeposited from Bath B as described in Table I at various current densities and at various temperatures over the range of room temperature (~20° C.) to 60° C. The results of these electrodepositions in terms of percent (by weight) nickel in the deposit versus current density are depicted in the drawing. Referring now thereto, the drawing shows that as the temperature increases there is a significant increase in the amount of nickel in the zinc-nickel alloy electrodeposit. At any given temperature, the amount of nickel in the electrodeposit generally decreases with increasing current density.

EXAMPLE III

Samples of nickel-zinc alloy were electrodeposited on mild steel substrates from Bath A as described in Table I at various current densities. These deposits were semibright, adherent and protective of the substrate. No difficulty was encountered in providing nickel-zinc alloy deposits containing about 18% to 24% nickel in thicknesses up to about 30 μm.

EXAMPLE IV

A plating bath, identical in composition to Bath B of Table I but having a pH adjusted to 3.4 with sulfamic acid was used at 45° C. to make electrodeposits on steel substrates at cathode current densities of 10 to 50 mA cm$^{-2}$. The deposits showed no evidence of pitting due to gassing, treeing or edge nodule growth. The nickel-zinc alloy deposits had nickel contents in the range of 24% nickel to 32% nickel the higher nickel contents being produced at the lower cathode current densities and vice versa. No hydroxide inclusions in the deposits were observed using Xray dispersion analysis.

EXAMPLE V

A plating bath, identical in composition to Bath A of Table I was operated at 45° C. to plate mild steel substrates with nearly bright, uniform nickel-zinc alloy containing about 21% to 24% nickel. The cathode current density was about 11 to 14 mA cm$^{-2}$ and the cathode current efficiency was greater than about 91%. When the bath pH was raised to 4.2, deposits produced at this higher pH were dull.

The present invention can be employed usefully to electroplate steel and other corrodible substrates for service in situations where pure zinc coatings have insufficient corrosion resistance. The alloy deposits of the invention can be used either alone or in association with a covering layer of zinc applied electrolytically or otherwise. Corrodible substrates can be steel or steel coated with nickel; copper or other metal. The present invention is particularly useful in providing an electrodeposit which can replace cadmium coatings thus avoiding environmental difficulties. Plating baths in accordance with the present invention are easy to operate and analyze and can be maintained essentially by anodic dissolution coupled with periodic adjustment through addition of readily available nickel and zinc salts.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A process for electrodeposition of nickel-zinc alloy containing about 8% to 35% by weight of nickel, balance essentially zinc comprising cathodically depositing such alloy on a substrate from a plating bath containing about 50 to 60 gpl of divalent nickel added as the sulfamate, about 5 to about 14 gpl of zinc added as the sulfate, about 20 to 35 gpl of boric acid with the balance being essentially water and free acid sufficient to adjust the pH of the plating bath to within the range of 2.5 to 4.0 while maintaining said bath at a temperature from about 20° C. to about 70° C. and a cathode current density of about 10 to 25 mA cm$^{-2}$.

2. A process as in claim 1 wherein the zinc content of the bath is about 6 gpl and the pH is adjusted to 2.5 to 2.8.

3. A process as in claim 1 wherein the zinc content of the bath is about 13 gpl and the pH is adjusted to about 3.8.

4. A process as in claim 1 wherein the temperature is maintained at about 40° C. to 50° C.

5. An electroplating bath for electrodepositing nickel-zinc alloy containing about 50 to 60 gpl of divalent nickel added as the sulfamate, about 5 to about 14 gpl of zinc added as the sulfate, about 20 to 35 gpl of boric acid with the balance being essentially water and free acid sufficient to adjust the pH of the plating bath to within the range of 2.5 to 4.0.

6. An electroplating bath as in claim 5 wherein the zinc content is about 6 gpl and the pH is adjusted to 2.5 to 2.8.

7. An electroplating bath as in claim 5 wherein the zinc content is about 13 gpl and the pH is adjusted to about 3.8.

8. A substrate having thereon a nickel-zinc alloy containing about 8% to 35% by weight of nickel, balance essentially zinc electrodeposited from the bath of claim 5.

* * * * *